United States Patent [19]

Moore

[11] Patent Number: 4,624,056

[45] Date of Patent: Nov. 25, 1986

[54] SIGHT FORK FOR ALIGNING SIGHTS ON SMALL FIREARMS

[76] Inventor: Harry E. Moore, 5436 Spruce St., Philadelphia, Pa. 19139

[21] Appl. No.: 704,492

[22] Filed: Apr. 3, 1985

[51] Int. Cl.[4] ..... G01B 5/25

[52] U.S. Cl. ..... 33/180 R; 33/286; 33/233

[58] Field of Search ..... 33/180 R, 233, 234, 33/168 R, 286, 412

[56] References Cited

U.S. PATENT DOCUMENTS

| | | | |
|---|---|---|---|
| 2,760,272 | 8/1956 | Van Cantie | 33/180 R |
| 3,088,212 | 5/1963 | Smith | 33/180 R |
| 3,190,002 | 6/1965 | Bliss | 33/233 |
| 3,193,942 | 7/1965 | Cates | 33/180 R |
| 3,350,787 | 11/1967 | Romano | 33/180 R |
| 3,678,588 | 7/1972 | Isola et al. | 33/180 R |
| 4,000,574 | 1/1977 | Grant | 333/233 |

FOREIGN PATENT DOCUMENTS

| | | | |
|---|---|---|---|
| 15452 | 11/1911 | United Kingdom | 33/233 |

*Primary Examiner*—Willis Little

*Attorney, Agent, or Firm*—Richard C. Litman

[57] ABSTRACT

A tool for handguns has a notch at the front end to surround the front sight of a pistol on three sides and a elevated thinner stem that extends over the center notch in the adjustable rear sight.

1 Claim, 5 Drawing Figures

SIGHT FORK FOR ALIGNING SIGHTS ON SMALL FIREARMS

BACKGROUND OF THE INVENTION

The basic gun sight alignment apparatus is secured to the gun by bolts, clamps, adhesion, etc., or the gun is placed in a vise like apparatus that is bolted or clamped to a bench, or in some way weighted down. Several shots must be fired in order to obtain the correct alighment of the gun sights.

The following list of patents disclose designs that have been conceived.

| Patent Number | Patentee | Issue Date |
|---|---|---|
| 2,927,375 | Luebkeman | 3/8/60 |
| 3,190,002 | Bliss | 6/22/65 |
| 3,744,143 | Kilpatrick | 7/10/73 |
| 3,930,316 | Tellie | 6/6/76 |

However, they all must be attached to the gun. Luebkeman and Kilpatrick disclose a tubular type of attachment that can restrict the shooter to the use of one eye. Bliss discloses an arrangement of a small aperture through the rear sight block and a similar aperture through the front sight blade that depend on a beam of light in front of the gun. Tellie discloses a sighting means that require peepholes similar to the Bliss patent.

The previously named inventors have added weight to the gun that effects the balance of the gun that is very important to the shooter. The light source mentioned by Bliss and by Tellie are not always available.

The method used to secure the previous named inventions to the gun can damage the gun.

SUMMARY OF THE INVENTION

The present invention comprises a one piece instrument with prongs on one end and a stem on the other end. The object of the present invention is to provide a quick and accurate means of aligning the sights on firearms equipped with adjustable sights, especially hand guns.

In contrast to the previously mentioned inventions, this invention is void of attachments such as clamps, screws and adhesives that can damage the gun and alter the manufacture's design. This invention is portable and can be utilized on guns of various caliber and length in a matter of minutes. This invention has no moving parts and can be manufactured of various materials, plastic, aluminum, etc.

BRIEF DESCRIPTION OF THE DRAWINGS

The particular features of the invention will become apparent from the following description taken in connection with the accompanying drawings.

DESCRIPTION OF THE PREFERRED EMBODIMENT

Figure 1:
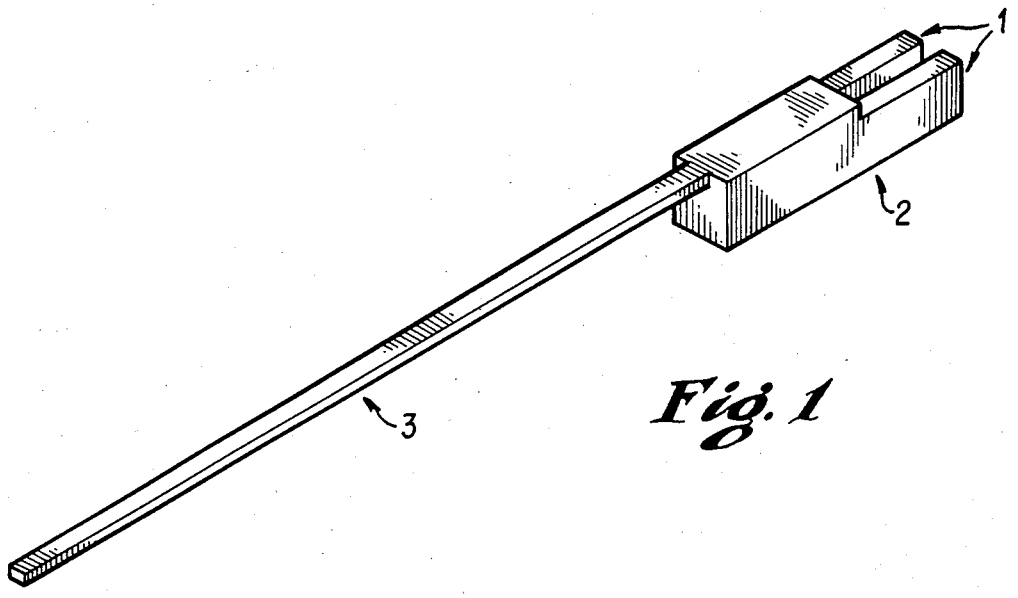
FIG. 1 is a top view of the invention showing, Prongs (1), Base (2), and Stem (3).
Figure 2:
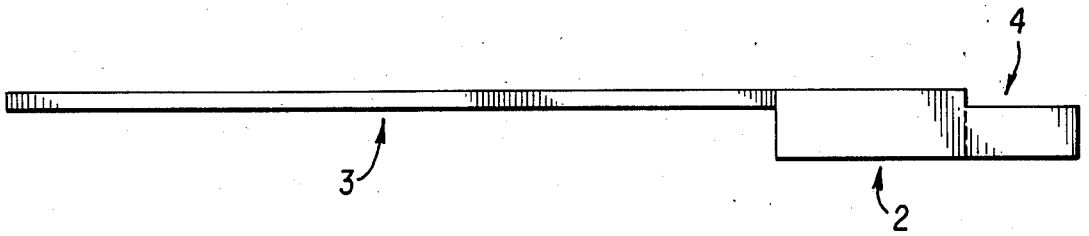
FIG. 2 is a side view of the invention showing, Base (2), Stem (3), and Step (4).
Figure 3:
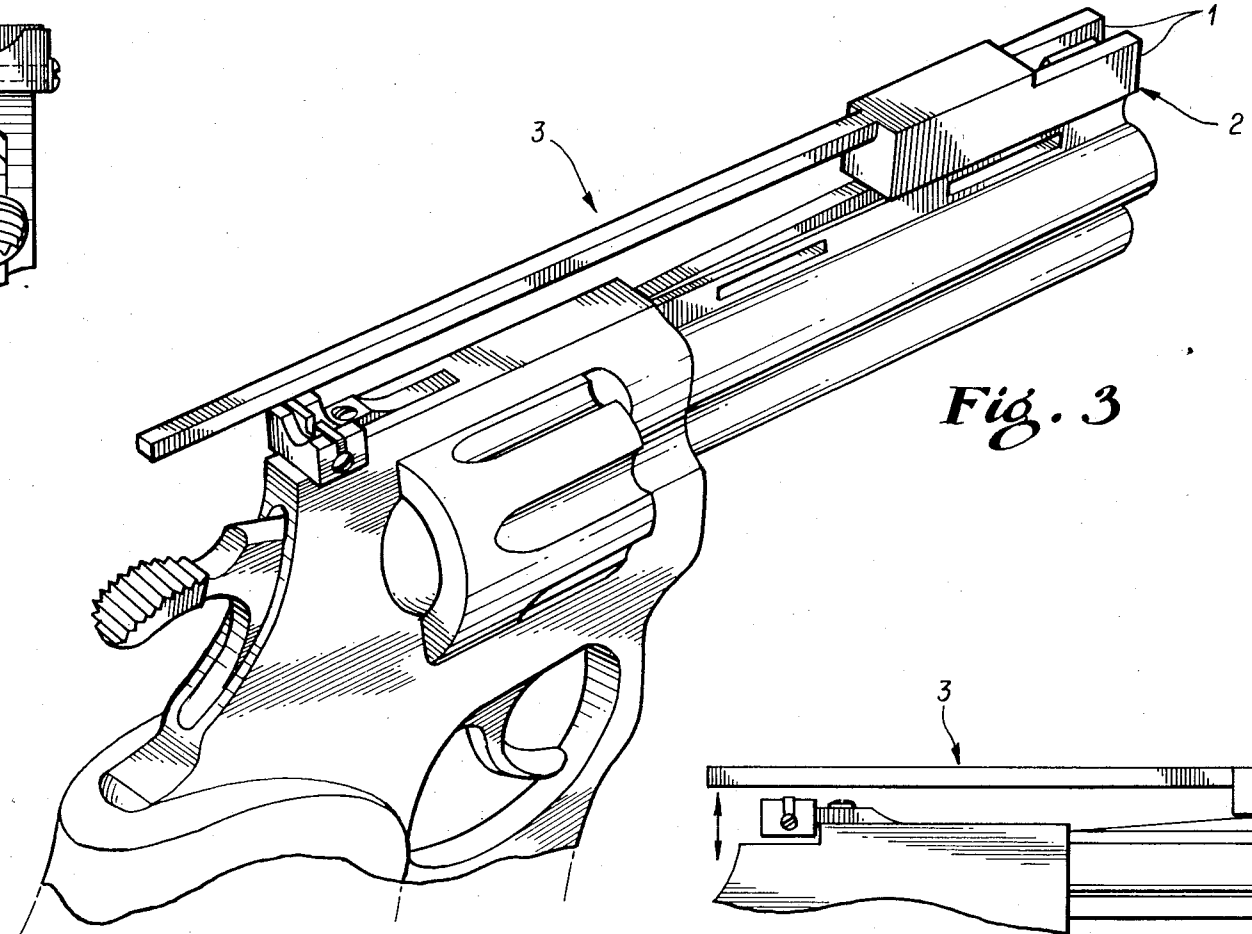
Figure 5:
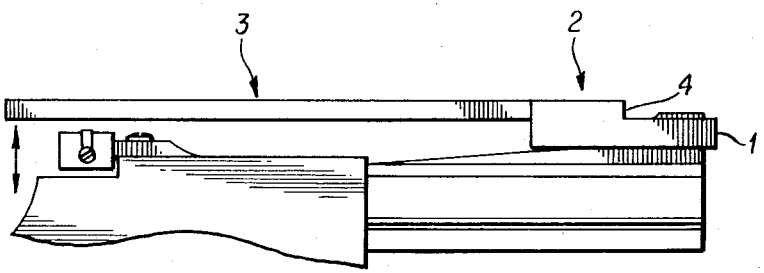
Figure 4:
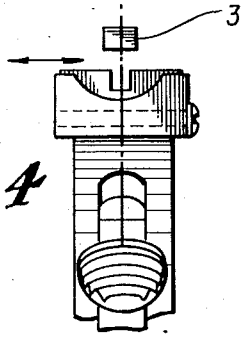

Referring to the drawings, the front sight blade of a pistol is placed between the prongs of the fork, the stem of the fork pointing toward the rear sight of the pistol. The base placed flat on the top of the piston barrel. The rear sight is then adjusted to the right or left untill the notch in center of the rear sight is aligned with the stem of the fork. This adjustment will give the shooter a perfectly straight shot. The sight fork is then placed on either side of the front sight of the pistol, the base held flat on the top of the pistol barrell, the stem pointing toward the rear sight of the pistol. The rear sight is adjusted up or down until the top of the rear sight is aligned with the bottom of the stem and the top of the prongs. The up or down of the rear sight will adjust elevation of the rear sight. The two adjustments will align the gun to a point of complete accuracy. The one piece instrument can be manufactured of various materials aluminum, iron, plastic, etc. The dimension of the invention can be determined by the manufacture's specifications, (a) length of the gun (b) thickness of the front blade sight that is placed between the prongs.

The sight fork is not attached to the gun and can be used on different guns in a span of minutes, and cannot damage the gun the way bolts, screws, clamps, etc. will.

This invention eliminates the many extra shots that would be required to gain accurate alignment by other methods.

I claim:

1. A method for aligning the front and rear sights of a handgun, using a device comprised of a support block having a full section and a stepped section having prongs which form a centered longitudinal slot therein and a stem extending from the upper center surface of the opposite end of the full section of said support block, comprising the steps of:

placing the prong-shaped stepped section adjacent the top surface of the gun barrel so that the centered longitudinal slot extends around the front blade sight so that said slot adjoins the front blade sight on three sides from the rear and placing the stem adjacent the top surface of the adjustable rear sight; and adjusting the rear sight of said handgun laterally and vertically according to the alignment of the stem adjacent the top surface of the rear sight.

* * * * *